US006674227B2

(12) United States Patent
Kim et al.

(10) Patent No.: US 6,674,227 B2
(45) Date of Patent: Jan. 6, 2004

(54) ELECTRON GUN FOR CATHODE-RAY TUBE

(75) Inventors: Tae-Kyu Kim, Seoul (KR); Hyun-Cheol Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 09/878,179

(22) Filed: Jun. 12, 2001

(65) Prior Publication Data

US 2002/0021077 A1 Feb. 21, 2002

(30) Foreign Application Priority Data

Jun. 13, 2000 (KR) ..... P2000-32297

(51) Int. Cl.[7] ..... H01J 29/50
(52) U.S. Cl. ..... 313/414; 313/409
(58) Field of Search ..... 313/447, 452, 313/414, 446, 412, 409

(56) References Cited

U.S. PATENT DOCUMENTS 5,077,498 A * 12/1991 Odenthal ..... 315/15
5,221,875 A * 6/1993 Odenthal ..... 313/447
5,397,959 A * 3/1995 Takahashi et al. ..... 313/414
5,606,216 A * 2/1997 Uchida et al. ..... 313/389
5,689,158 A * 11/1997 Chen ..... 313/409
5,814,930 A * 9/1998 Watanabe et al. ..... 313/414
5,831,399 A * 11/1998 Ohta et al. ..... 313/414
6,121,724 A * 9/2000 Hasegawa et al. ..... 313/412
6,288,482 B1 * 9/2001 Watanabe et al. ..... 313/414
2001/0000942 A1 * 5/2001 Shiroishi et al. ..... 313/414

FOREIGN PATENT DOCUMENTS

JP 11-224618 * 8/1999 ..... H01J/29/48

* cited by examiner

*Primary Examiner*—Ashok Patel
*Assistant Examiner*—Glenn D. Zimmerman
(74) *Attorney, Agent, or Firm*—Fleshner & Kim, LLP

(57) ABSTRACT

There is provided an electron gun for a cathode-ray tube, comprising a triode having a control electrode and an accelerating electrode for controlling the amount of electron beams emitted from a plurality of cathodes and accelerating the electron beams, a front focusing lens part configured of a plurality of electrodes focusing and accelerating a predetermined amount of the electron beams, and a main lens part configured of a plurality of electrodes for focusing the electron beams on a screen, in which the diameter of beam passage hole of the accelerating electrode of the triode corresponds to 140–220% of that of the control electrode. The thickness of the control electrode corresponds to 20–30% of the diameter of beam passage hole of the control electrode, and the distance between the control electrode and the accelerating electrode corresponds to 40–80% of the beam passage hole diameter of the control electrode. Accordingly, the spot size of the electron beam in a high current region is reduced to realize picture quality with high resolution.

2 Claims, 7 Drawing Sheets

ELECTRON GUN FOR CATHODE-RAY TUBE

BACKGROUND OF THE INVENTION

1. Field of the Invention

The present invention relates to an electron gun for a cathode-ray tube and, more particularly, to the structure of control and accelerating electrodes corresponding to a triode of an electron gun, which is for reducing the spot size of an electron beam in a high current region of a cathode-ray tube with high picture quality that requires high resolution.

2. Description of the Related Art

As shown in FIG. 1, a general color cathode-ray tube includes a panel 10 having a fluorescent film 11 formed on the inner side thereof, a funnel 12 formed at the rear of the panel, being combined with it, a neck 20 connected to the funnel at the back of the funnel, having an electron gun 30 placed thereinside, a deflection yoke 18 located on the outer surface of the funnel to deflect electron beams upward, downward, left and right, a shadow mask 14 placed inside the panel to perform sorting of colors, and a frame 16 supporting the shadow mask to fix it to the panel.

In the cathode-ray tube constructed as above, hot electrons are emitted from cathodes of the electron gun 30 when a video signal is applied to the electron gun 30. The emitted electrons are accelerated and focused toward the panel 10 according to a voltage applied thereto from electrodes of the electron gun. Here, the traveling path of the electron beams is adjusted by the magnetic field of a magnet set at the neck 20, and the electron beams whose traveling path was controlled scan the fluorescent film 11 formed on the inner surface of the panel 10 according to the deflection yoke 18. The deflected electron beams are subjected to color sorting while passing through lots of holes of the shadow mask 14. The color-sorted electron beams collide with the fluorescent film 11 to emit lights, presenting the video signal.

The in-line electron gun 30 placed inside the neck 20 includes control, accelerating and focusing electrodes which are located perpendicular to the traveling path of the electron beams, having a predetermined distance between neighboring electrodes, such that the electron beams generated from the cathodes can be controlled by a voltage with a predetermined level applied by the electrodes to arrive at the screen. Referring to FIG. 2, the conventional electron gun 30 for the cathode-ray tube has a tri-electrodes part 33, a front focusing lens part 34, and a main lens part 35. The tri-electrodes part 33 consists of three R, G, B cathodes 31, the control electrode G1 serving as a common grating of the three cathodes, being placed having a predetermined distance from the cathodes, and the accelerating electrode G2 located having a predetermined distance from the control electrode.

The front focusing lens part 34 is constructed of a front focusing electrode G3 placed a predetermined interval from the accelerating electrode G2, and a second accelerating electrode G4 arranged a predetermined distance from the front focusing electrode G3. The main lens part 35 includes a focusing electrode 05 located a predetermined distance from the second accelerating electrode and an anode 06 placed a predetermined distance from the accelerating electrode. The upper and lower portions of the aforementioned electrodes are inserted into a support called bead glass 39, being fixed having a predetermined interval. A shield cup 37 as a shield electrode for shielding and weakening leakage magnetism of the deflection yoke 18 is formed at the end of the anode G6.

The electron gun 30 having the above-described structure generates hot electrons when a heater 32 included in the cathode 31 is heated, and these generated electrons form electron beams (R, G, B). After the amount of emission of the electron beams is determined by the control electrode G1, the electron beams emitted are accelerated by the accelerating electrode G2 and subjected to repeated focusing and accelerating processes while passing through the front focusing lens part 34 and the main lens part 35, to be finally deflected by the deflection yoke 18 horizontally or vertically to scan the fluorescent plane 11.

The control electrode G1 of the tri-electrodes part 33 is grounded and the accelerating electrode G2 is provided with a voltage of 500–1000V The anode G6 of the main lens part 35 accepts a high voltage of 25–35 kV and the focusing electrode G5 is provided with an intermediate voltage of 20–30% of the voltage applied to the anode G6. Furthermore, the accelerating electrode G2 and the second accelerating electrode G4 are supplied with the same voltage and the front focusing electrode G3 and the focusing electrode GS are provided with the same voltage.

In general, the size of the spot at which the electron beam is focused depends on a spherical aberration generated when the electron beam passes through a passage hole of each electrode. The spot size of electron beam increases due to large spherical aberration, so that the sharpness of the electron beam is reduced, to result in deteriorate the resolution.

In the general cathode-ray tube using the in-line electron gun, three electron beams of red, green and blue are horizontally arranged in parallel. This requires a magnetism-concentrating type deflection yoke using a non-uniform magnetic field in order to converge the three electron beams on one point of the fluorescent plane 11. The distribution of the magnetic field generated by the magnetism-concentrating deflection yoke 18 has a pincushion type horizontal deflection magnetic field and a barrel type vertical deflection magnetic field, to prevent misconvergence on the fluorescent plane This magnetic field has a two-pole component and a four-pole component. The two-pole component deflects the electron beams in a horizontal or vertical direction and the four-pole component performs not only the horizontal or vertical deflection but also prevention of misconvergence. However, these components focus the electron beams in a direction of deteriorating the resolution, that is, vertical direction, diverge the electron beams in the horizontal direction, to result in generation of astigmatism, distorting the spot of the electron beam. This distorted electron beam generates haze called phenomenon spreading of beam phase at its core and the top and bottom thereof, bringing about deterioration in the resolution at the marginal area of the screen. To solve this problem, a horizontally long groove (A) is formed at the accelerating electrode G2, as shown in FIG. 3B.

The electrodes of the electron gun have the electron beam (R, G, B) passage holes formed having a predetermined eccentric distance SI as shown in FIGS. 3A and 3B. The electron beams travel having a predetermined eccentric distance among them, and focus on one point of the fluorescent plane 11 when they proceed to the panel from the main lens part 34. In case of the conventional electron gun, the diameter of the beam passage hole of the control electrode G1 generally corresponds to 0.5–0.6 mm and that of the accelerating electrode G2 is similar to that of the control electrode G1 or increased by about 10% of thereof.

Recently, the holes of the control electrode G1 and the accelerating electrode G2 have a square shape not the circular one to improve the resolution.

According to a tendency of enlargement of cathode-ray tube size and high resolution of the cathode-ray tube, a high-precision shadow mask is adopted in order to accomplish high resolution required for HDTV, for example, to realize high quality broadcasting and monitoring. The achievement of high resolution also needs a decrease in the spot size corresponding to the pixel size. To reduce the spot size of the electron beam, the effective aperture of the main lens is increased or the diameter of the beam passage hole of the control electrode G1 is reduced. However, the reduction in the diameter of the beam passage hole of the control electrode G1 shortens the distance between the cathodes 31 and the control electrode G1. This degrades activation of hot electrons to deteriorate electrical characteristic, generating a case where large quantity of current cannot be used. Furthermore, capacitance between the cathodes 31 and the control electrode G1 increases to decrease the video bandwidth of TV, deteriorating the resolution.

SUMMARY OF THE INVENTION

It is, therefore, an object of the present invention to provide an electron gun for a cathode-ray tube in which the diameter of the beam passage hole of the accelerating electrode of the tri-electrode part is larger than that of the control electrode and the control electrode is thicker than the conventional one, to reduce the electron beam spot size in a high current region, realizing picture quality with high resolution.

To accomplish the object of the present invention, there is provided an electron gun for a cathode-ray tube, comprising a tri-electrode part having a control electrode and an accelerating electrode for controlling the amount of electron beams emitted from a plurality of cathodes and accelerating the electron beams, a front focusing lens part configured of a plurality of electrodes focusing and accelerating a predetermined amount of the electron beams, and a main lens part configured of a plurality of electrodes for focusing the electron beams on a screen, in which the diameter of beam passage hole of the accelerating electrode of the tri-electrode part corresponds to 140–220% of that of the control electrode, and the thickness of the control electrode corresponds to 20–30% of the diameter of beam passage hole thereof.

DETAILED DESCRIPTION OF THE PREFERRED EMBODIMENT

Reference will now be made in detail to the preferred embodiments of the present invention, examples of which are illustrated in the accompanying drawings.

The present invention proposes a method of reducing the electron beam spot size in order to accomplish high resolution. The spot size should be small in the high current region in case of an electron gun used for TV whereas the spot size is required to be small in a low current region in case of an electron gun used for a monitor. Accordingly, the present invention carried out a variety of experiments to reduce the spot size of each of red, green and blue electron beams in case of current of 3000 $\mu$A or more in order to decrease the spot size in the high current region.

EXPERIMENTAL EXAMPLES

The present invention measured responsiveness of the spot size with respect to the beam passage hole diameter and thickness of the control electrode G1, the accelerating electrode G2 and the front focusing electrode G3 and the distance between neighboring electrodes within an error range of each factor (diameter, distance and thickness) ±0.05 mm. In the experiment, the beam passage hole diameters of the control electrode G1, the accelerating electrode G2 and the front focusing electrode G3 were 0.5±0.05 mm, 0.5±0.05 mm and 1.05±0.05 mm, respectively. In addition, the distance between the control electrode G1 and the accelerating electrode G2 was 0.15±0.05 mm and the distance between the accelerating electrode G2 and the front focusing electrode G3 was 1.0±0.05 mm.

Figure 1:
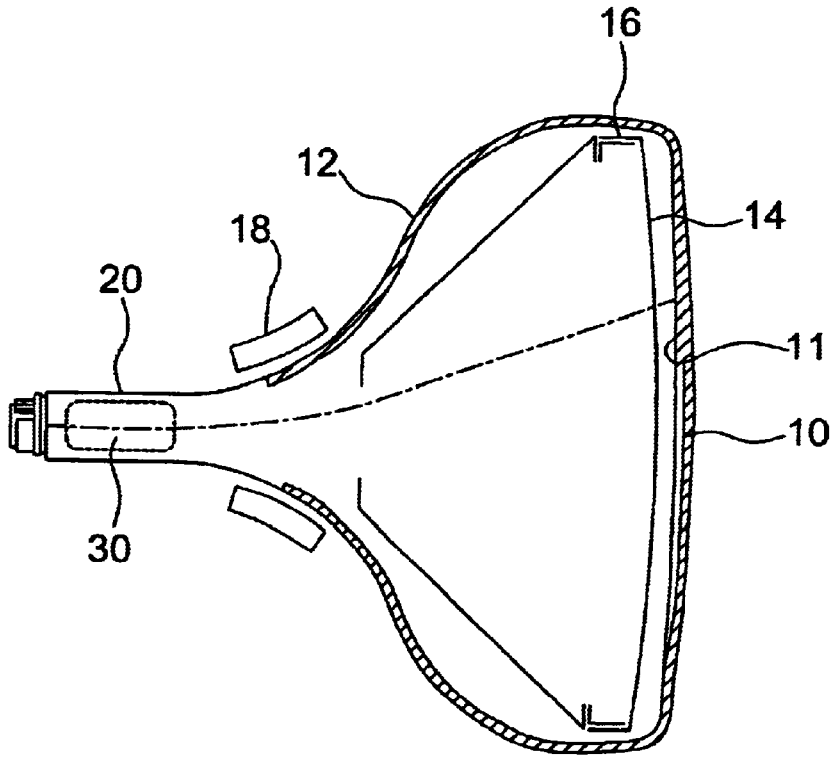
FIG. 1 PRIOR ART
FIG. 1 is a side view showing the section of a conventional cathode-ray tube.
Figure 2:
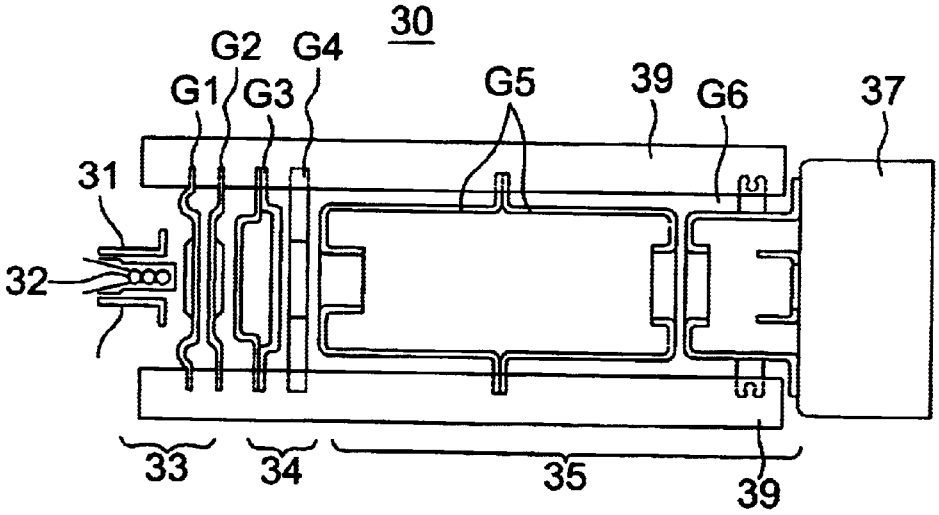
FIG. 2 PRIOR ART
FIG. 2 shows the structure of a conventional electron gun.
Figure 3A:
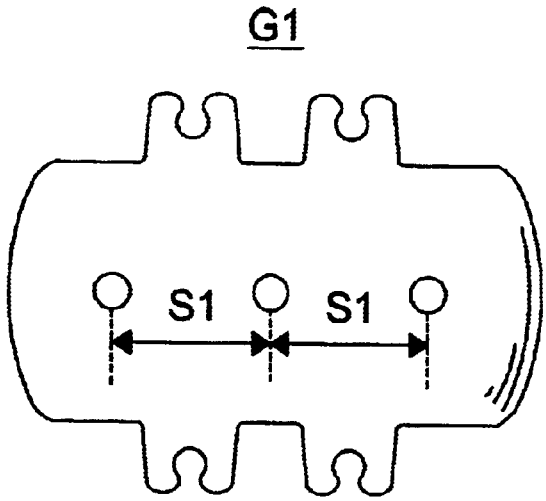
FIG. 3a PRIOR ART
FIGS. 3A and 3B are front views showing the control electrode and the accelerating electrode of FIG. 2, respectively.
Figure 3B:
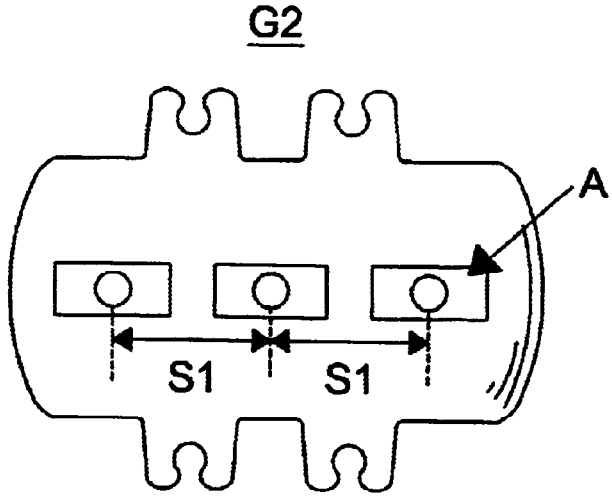
FIG. 3b PRIOR ART
Figure 4:
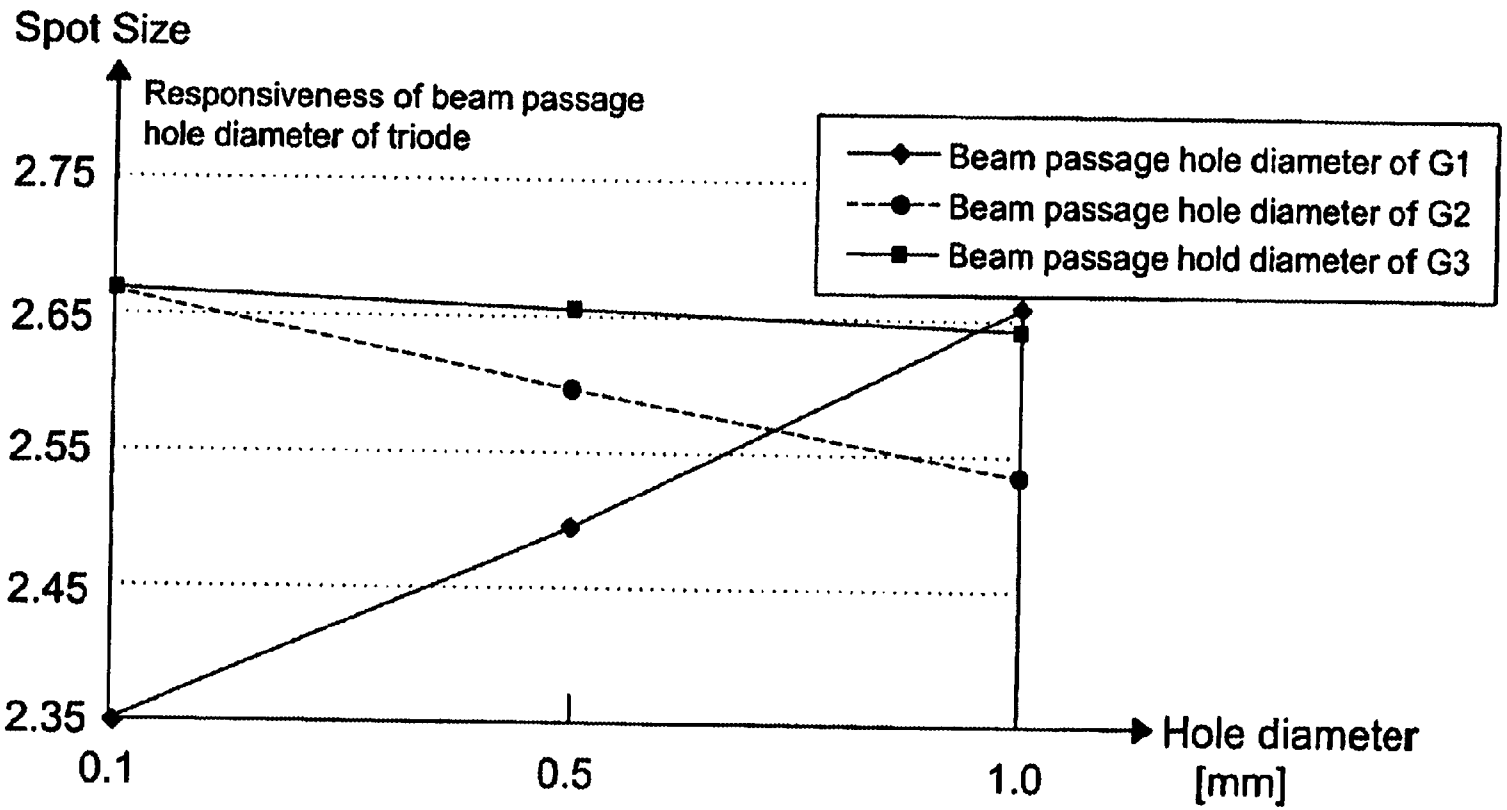
FIG. 4 is a graph showing the relationship between the electron beam spot size and beam passage hole diameters of the control electrode G1, accelerating electrode G2 and front focusing electrode G3.

The result obtained from the experiment under the aforementioned condition is shown in FIG. 4. Referring to FIG. 4, the size of spot focused on the fluorescent plane 11 decreases rapidly as the beam passage hole diameter of the control electrode G1 becomes smaller but that of the accelerating electrode G2 becomes larger. The beam passage hole diameter of the front focusing electrode G3 barely affects the spot size. From this, it can be known that the spot size reacts upon the beam passage hole diameter of the control electrode G1 most sensitively, and has considerably large responsiveness to that of the accelerating electrode G2. It can be also found that the diameters of the control electrode G1 and the accelerating electrode G2 react on the spot size in the opposite direction. That is, to reduce the spot size requires that the beam passage hole diameter of the control electrode G1 is decreased but that of the accelerating electrode G2 is increased.

Figure 5:
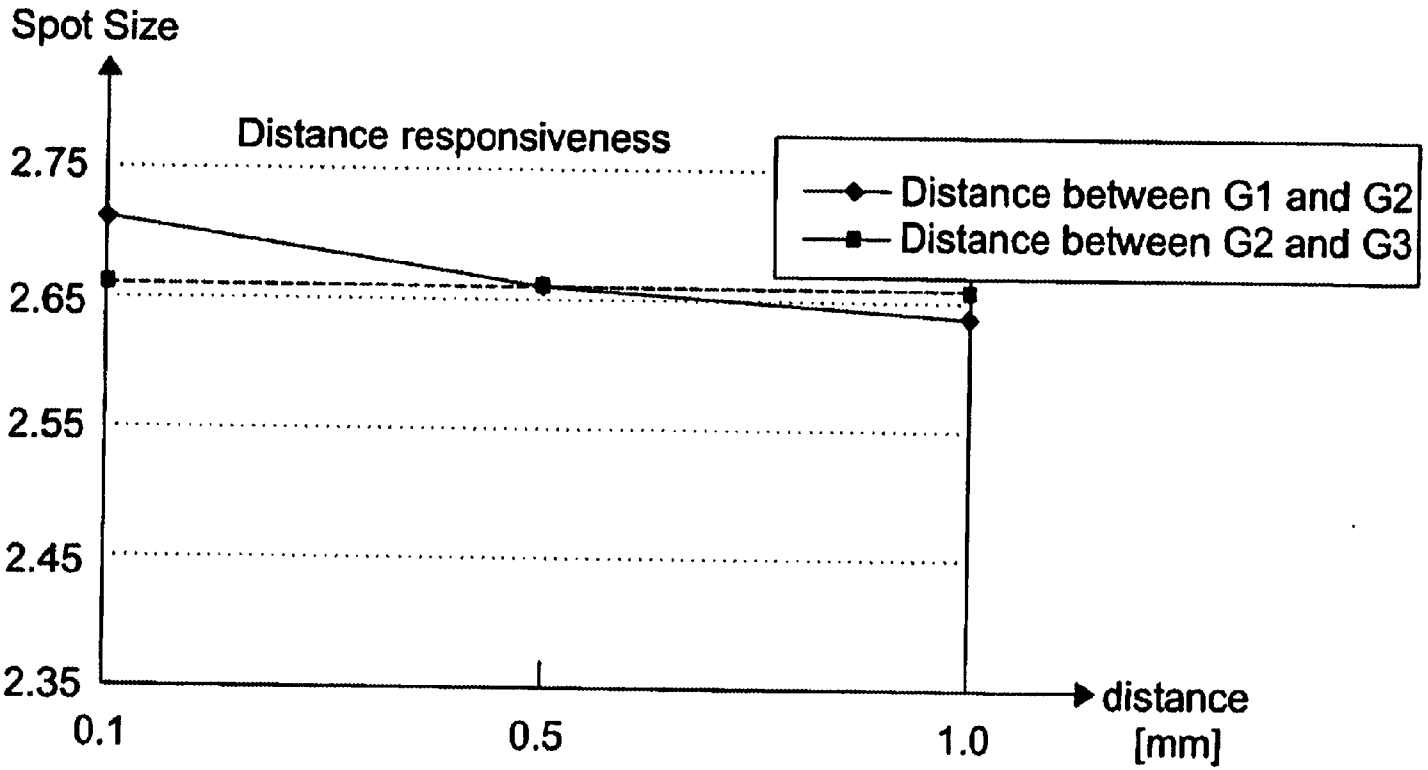
FIG. 5 is a graph showing the electron beam spot size with respect to the distance between the control electrode G1 and accelerating electrode G2 and the beam passage hole diameters of the accelerating electrode G2 and front focusing electrode G3.
Figure 6:
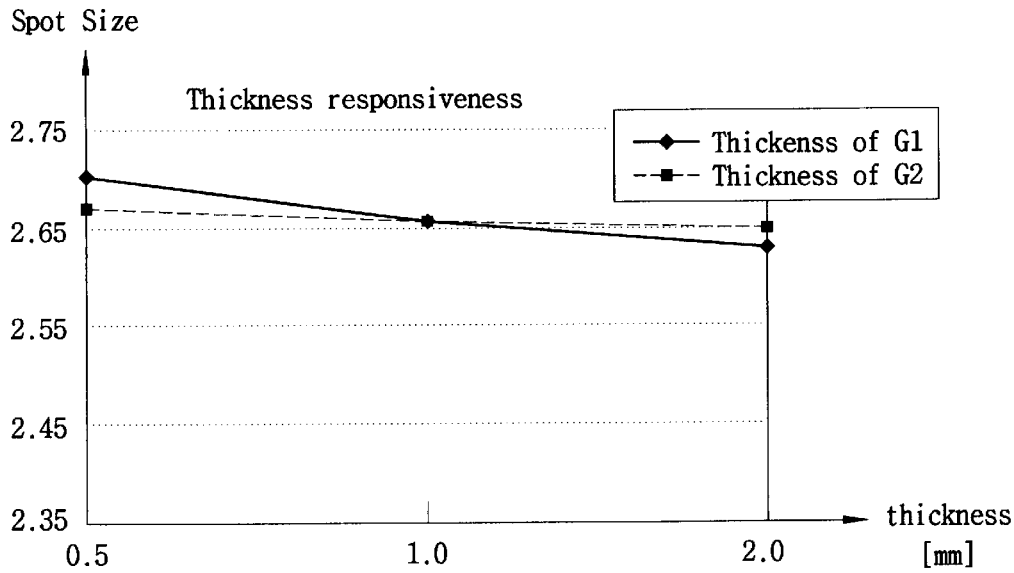
FIG. 6 is a graph showing the relationship between the thickness of the control electrode G1 and accelerating electrode G2 and the electron beam spot size.

FIG. 5 shows the responsiveness of the spot size to the distance between neighboring electrodes. As shown in FIG. 5, it can be known that the distance between the control electrode G1 and the accelerating electrode G2 reacts on the spot size more sensitively than the distance between the accelerating electrode G2 and the front focusing electrode G3, and the distance between the accelerating electrode G2 and the front focusing electrode G3 hardly affects the spot size. Referring to FIG. 6, the thickness of the control electrode G1 reacts on the spot size more strongly than that of the accelerating electrode G2.

These experimental results are represented by the responsiveness of each electrode with respect to the spot size by factors in the following table.

TABLE 1

| Factor | Diameter of G1 | Diameter of G2 | Diameter of G3 | Distance G1–G2 | Distance G2–G3 | Thickness of G1 | Thickness of G2 |
|---|---|---|---|---|---|---|---|
| Responsiveness | 2.39 | −1.0 | −0.15 | −0.44 | 0.00 | −0.44 | −0.15 |

As shown in Table 1, only the beam passage hole diameter of the control electrode G1 is proportional to the spot size and the remaining factors are inversely proportional to it. The beam passage hole diameter of the control electrode G1 affects the spot size most strongly, followed by the diameter of the accelerating electrode G2, the distance between the control electrode G1 and the accelerating electrode G2, and the thickness of the control electrode G1. The beam passage hole diameter of the front focusing electrode G3, the distance between the accelerating electrode G2 and the front focusing electrode G3 and the thickness of the accelerating electrode G2 hardly affect the spot size.

As described above, however, the beam passage hole diameter of the control electrode G1 cannot be reduced without limit but it must have a predetermined limit for activation of electron beams. Accordingly, the present invention intended to increase the beam passage hole diameter of the accelerating electrode G2, to extend the distance between the control electrode G1 and the accelerating electrode G2 and to raise the thickness of the control electrode G1. With a variation in the distance between the control electrode G1 and the accelerating electrode G2, the spot size is barely reduced when the distance between the two electrodes became about 80% of the beam passage hole diameter of the control electrode G1 and the spot size can be decreased by 13% compared to the prior art by appropriately controlling the distance between the two electrodes.

Figure 7:
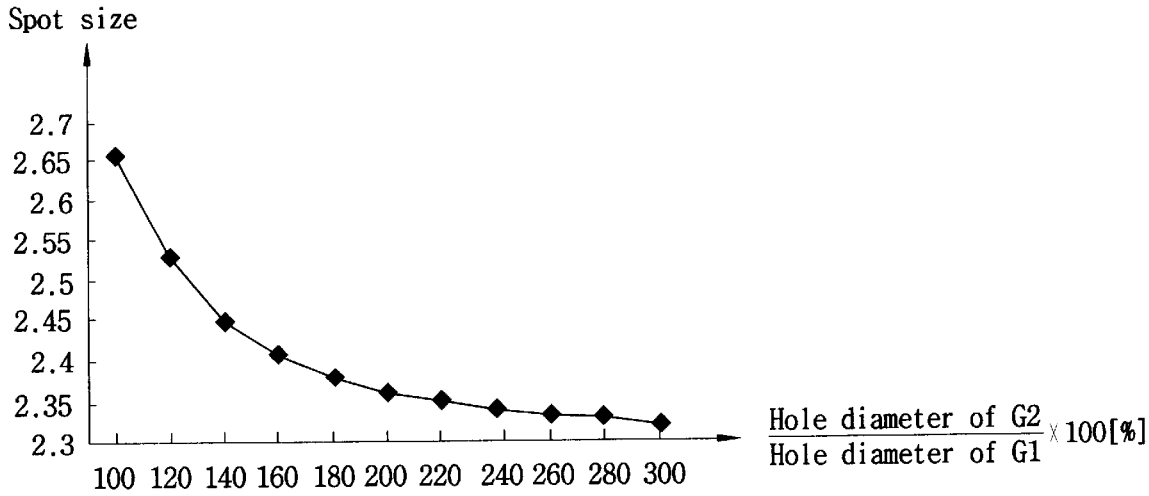
FIG. 7 is a graph showing the relationship between the spot size and the diameter of the beam passage hole of the accelerating electrode for the purpose of explaining the present invention.

That is, while the distance between the control electrode G1 and the accelerating electrode G2 corresponds to 30% of the beam passage hole diameter of the control electrode G1 in the prior art, it is adjusted to be 40–80% of the diameter to reduce the spot size, improving the resolution in the present invention. Furthermore, as shown in FIG. 7, in case where the beam passage hole diameter of the accelerating electrode G2 is increased to 220% of that of the control electrode G1 although the current hole diameters of them similar to each other, the spot size can be reduced by 12% approximately compared to the prior art.

As described above, it can be known that the spot size is decreased by about 13% when the beam passage hole diameter of the accelerating electrode G2 is increased to 220% of that of the control electrode G1 and the distance between them becomes 80% of the diameter of the control electrode. This is because the spot size depends on the beam passage hole diameter of the accelerating electrode G2 rather than the distance between the control electrode G1 and the accelerating electrode G2.

Figure 8A:
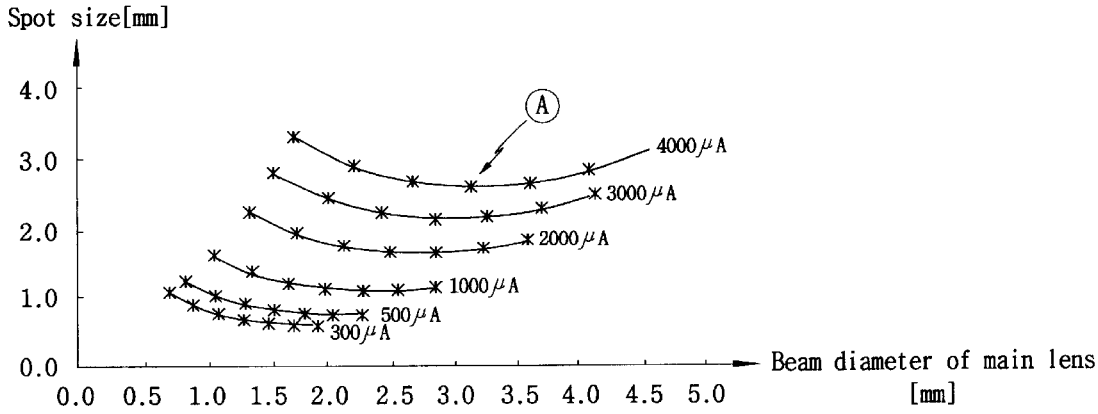
FIGS. 8A and 8B are graphs showing variations in the spot size in a high current region in accordance with the prior art and the present invention, respectively.
Figure 8B:
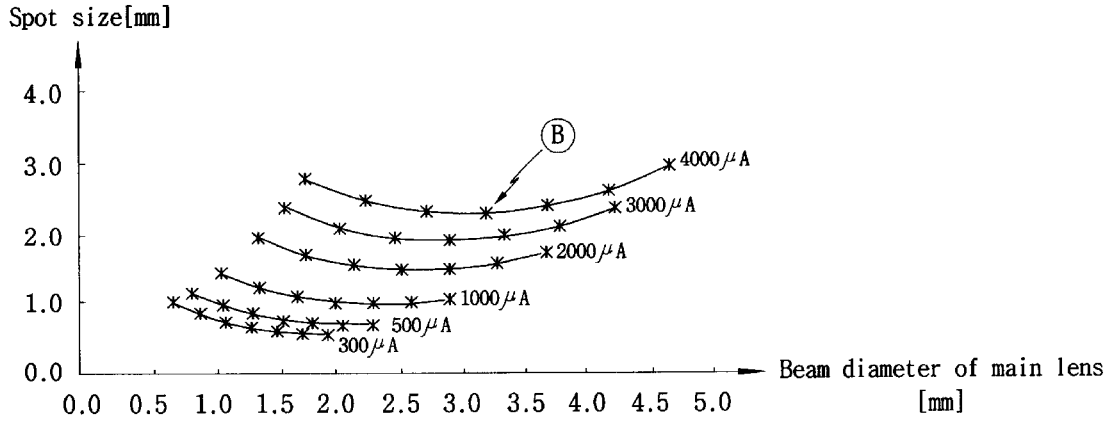

FIGS. 8A and 8B are graphs showing variations in the spot size in the high current region in accordance with the prior art and the present invention, respectively. Here, The spot size of green beam was measured at the center of the screen. From FIGS. 8A and 8B, it can be known that the spot size can be reduced by 13% in the high current region of 4000 $\mu$A approximately, compared to the prior art, as indicated by points (A) and (B) when the beam passage hole diameter of the accelerating electrode G2 is extended to 220% of that of the control electrode G1. That is, it can be found that the spot size is reduced to 2.31 mm in the high current region as represented by the point (B) though the conventional spot size is 2.66 mm in the high current region as indicated by the point (A). As described above, the spot size largely depends on the ratio of the hole diameter of the control electrode G1 and that of the accelerating electrode G2.

Moreover, although the current thickness of the control electrode G1 corresponds to about 20% of the beam passage hole diameter of the control electrode G1, the spot size is not decreased any more when the thickness of the control electrode G1 becomes more than 30% of the beam passage hole diameter of the control electrode G1. Thus, the spot size can be reduced by 5% when the thickness of the control electrode G1 is about 30% of the diameter thereof. Though the thickness of the control electrode G1 is not a factor strongly affecting the spot size, it can help reduce the spot size. The reduction in the spot size is for improving the resolution. Since the resolution has a strong relation with the horizontal direction of pixel rather than the vertical direction, the decrease in the spot size means a reduction in the horizontal length of the spot.

In conclusion, the present invention extends the beam passage hole diameter of the accelerating electrode G2 to 140–220% of that of the control electrode G1 and increases the thickness of the control electrode G1 to 30% of the beam passage hole diameter thereof to reduce the spot size as distinguished from the prior art in which the control electrode G1 and the accelerating electrode G2 have the same beam passage hole diameter.

Therefore, according to the present invention, the beam passage hole diameter of the accelerating electrode G2 is extended to 140–220% of that of the control electrode G1 and the thickness of the control electrode G1 is increased up to 30% of the beam passage hole diameter thereof to decrease the spot size of electron beam in the high current region, realizing picture quality with high resolution.

Although specific embodiments including the preferred embodiment have been illustrated and described, it will be obvious to those skilled in the art that various modifications may be made without departing from the spirit and scope of the present invention, which is intended to be limited solely by the appended claims.

What is claimed is:

1. An electron gun for a cathode-ray tube, comprising a ti-electrode part having a control electrode and an accelerating electrode for configured to control an amount of electron beams emitted from a plurality of cathodes and to accelerate the electron beams;

a front focusing lens part comprising a plurality of electrodes configured to focus and to accelerate the electron beams; and a main lens part comprising a plurality of electrodes configured to focus the electron beams on a screen, wherein a diameter of beam passage holes of the accelerating electrode of said ti-electrode part corresponds to approximately 140–220% of a diameter of beam passage holes of the control electrode, and wherein a distance between the control electrode and the accelerating electrode corresponds to approximately 40–80% of the beam passage hole diameter of the control electrode, and wherein a thickness of the control electrode corresponds to approximately 20–30% of the beam passage hole diameter of the control electrode.

2. A cathode-ray tube comprising the electron gun of claim 1.

* * * * *